US011825969B1

(12) United States Patent
Shockey

(10) Patent No.: US 11,825,969 B1
(45) Date of Patent: Nov. 28, 2023

(54) FIDGET COASTER

(71) Applicant: Robert Shockey, La Verne, CA (US)

(72) Inventor: Robert Shockey, La Verne, CA (US)

(73) Assignee: Robert Shockey, La Verne, CA (US)

( * ) Notice: Subject to any disclaimer, the term of this patent is extended or adjusted under 35 U.S.C. 154(b) by 0 days.

(21) Appl. No.: 17/899,343

(22) Filed: Aug. 30, 2022

(51) Int. Cl.
*A47G 23/03* (2006.01)
*A63H 33/00* (2006.01)

(52) U.S. Cl.
CPC ..... *A47G 23/03* (2013.01); *A47G 23/0316* (2013.01); *A63H 33/00* (2013.01)

(58) Field of Classification Search
CPC .. A47G 23/03; A47G 23/0316; A47G 23/036; A63H 33/00; A63H 33/003; A63H 1/00; A63H 29/08; B43K 27/08; B43K 29/00; B60N 3/103; B60N 3/106
USPC ..... 248/346.11, 349.1
See application file for complete search history.

(56) References Cited

U.S. PATENT DOCUMENTS

| | | | | |
|---|---|---|---|---|
| 5,951,353 | A * | 9/1999 | Moore | A63H 33/18 446/5 |
| 7,607,629 | B1 * | 10/2009 | Carrasco | A61J 9/06 248/102 |
| 8,282,050 | B2 * | 10/2012 | Georgey | B65H 75/486 248/349.1 |
| 8,654,615 | B2 * | 2/2014 | Lin | G04B 19/223 368/27 |
| 9,199,765 | B1 * | 12/2015 | Lekic | A47G 23/0316 |
| 9,630,086 | B1 * | 4/2017 | Wahe | A63D 15/00 |
| 10,016,693 | B1 | 7/2018 | Dowdy | |
| 11,447,053 | B1 * | 9/2022 | Fan | B60N 3/106 |
| 2006/0243875 | A1 * | 11/2006 | Chen | B60N 3/106 248/311.2 |
| 2011/0185830 | A1 * | 8/2011 | Chen | A63H 29/00 74/5.22 |
| 2019/0105578 | A1 * | 4/2019 | Brous | A63H 13/20 |
| 2022/0176235 | A1 | 6/2022 | McLachlan | |

* cited by examiner

*Primary Examiner* — Nkeisha Smith
(74) *Attorney, Agent, or Firm* — Edison Law Group

(57) ABSTRACT

A fidget coaster is a finished wood and clear acrylic disk. The fidget coaster has a sprocket grip on the outside which allows the user to spin gears on the inside beneath the clear acrylic. The inside is made up of a planetary gear and three smaller gears that rotate around another gear at the center. The activity of holding it and spinning it, or lightly turning it with a drink perched on it, is relaxing. It aids conversation and provides focus for people who need to occupy themselves with fidgeting to allow them to concentrate.

20 Claims, 3 Drawing Sheets

FIDGET COASTER

BACKGROUND

Technical Field

This disclosure relates to designer drink coasters. In particular, but without limitation, the disclosure relates to a drink coaster with spinning components.

Spinner toys are known in the art.

U.S. Pat. No. 10,016,693 discloses a handheld spinner toy with stationery item.

US 2019/0105578 discloses a spinner toy.

US 2022/0176235 discloses a handheld touch apparatus with movable tactile features.

However, the art fails to disclose a spinner device that can serve as a beverage coaster.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

SUMMARY

A fidget coaster is disclosed which is made of finished wood and clear acrylic disk. It has a sprocket grip on the outside which allows the user to spin gears on the inside beneath the clear acrylic. The inside is made up of a planetary gear—a large gear with the teeth on the inside of the circle, and three smaller gears that rotate around another gear at the center. The activity of holding it and spinning it, or lightly turning it with a drink perched on it, is relaxing. It aids conversation and provides focus for people who need to occupy themselves with fidgeting to allow them to concentrate.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

The fidget coaster is a finished wood and clear acrylic disk mechanism. It has a sprocket grip on the outside ring which allows the user to spin gears on the inside beneath the clear acrylic. The internal mechanisms comprise planetary gear—a large gear with the teeth on the inside of the circle, and three smaller gears that rotate around another gear at the center. The activity of holding it and spinning it, or lightly turning it with a drink perched on it, is relaxing. It aids conversation and provides focus for people who need to occupy themselves with fidgeting to allow them to concentrate. These could also serve as coasters in a home bar, with the owner's vanity logo/name imprinted. A generic, non-printed version could be available as well.

Figure 1:
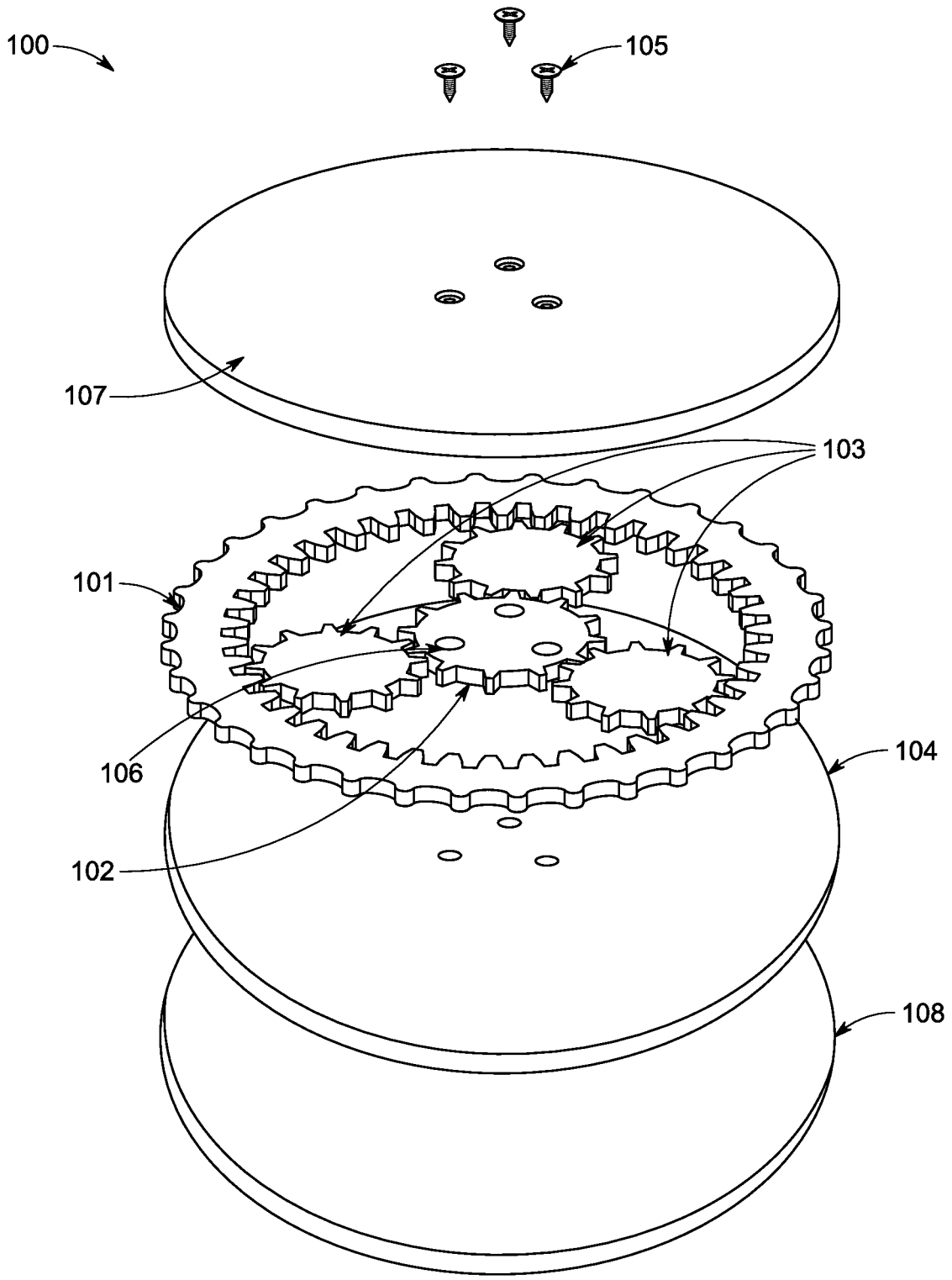
FIG. 1 is a view of an aspect of a fidget coaster according to the disclosure.

FIG. 1 is a view of an aspect of a fidget coaster 100 according to the disclosure. The fidget coaster 100 includes an outer annular gear 101 that is configured to spin freely about a central axis. The outer annular gear 101 has a plurality of sprockets formed on the outer edge of the outer gear 101, configured to allow a user to rotate the outer annular gear 101. The fidget coaster 100 includes a fixed solar gear 102 disposed in the center of the outer annular gear 101. A plurality of planetary gears 103 disposed along the edges symmetrically of the solar gear 102. In an aspect of the disclosure, the planetary gears may number more than 3, such as 6 or more planetary gears. The plurality of planetary gears 103 rotate around the solar gear 101 as the outer annular gear 101 is rotated by an external user. In other aspects of the disclosure, a center of each of the plurality of planetary gears 103 and a center of the solar gear 102 may have different shapes or patterns as manufactured.

In an aspect, the solar gear 102 is mechanically attached to a rigid base 104 by a plurality of fasteners 105. The plurality of fasteners 105 may be inserted and fastened via a plurality of holes 106 to accept the plurality of fasteners 105. The plurality of fasteners 105 may be screws. Other examples of fasteners may be employed as known to one of skill in the art. A supplemental bonding agent, such as epoxy, may be employed to secure the solar gear 102 to the rigid base 104.

The rigid base 104 may be composed of a suitable material, such as wood. The wood may be a hardwood plywood, oak, walnut, chestnut, or other sturdy materials.

The fidget coaster 100 includes a clear acrylic cover 107 which is secured to the fidget coaster 100 through the plurality of fasteners 105. The acrylic cover 107 may include regions that are countersunk so that the plurality of fasteners 105 present little or no profile above the acrylic cover 107 when inserted into the plurality of holes 106.

The fidget coaster 100 may include a non-skid base 108 below and attached to the rigid base 104. The non-skid base 108 may be composed of neoprene rubber to prevent motion of the fidget coaster 100 when placed on a surface. The non-skid base 108 may be ring-shaped or an annulus when mounted below the rigid base 104, which may allow emblems, logos, QR codes or advertising information. Other shapes and patterns are possible for the non-skid base 108 as desired.

Figure 2:
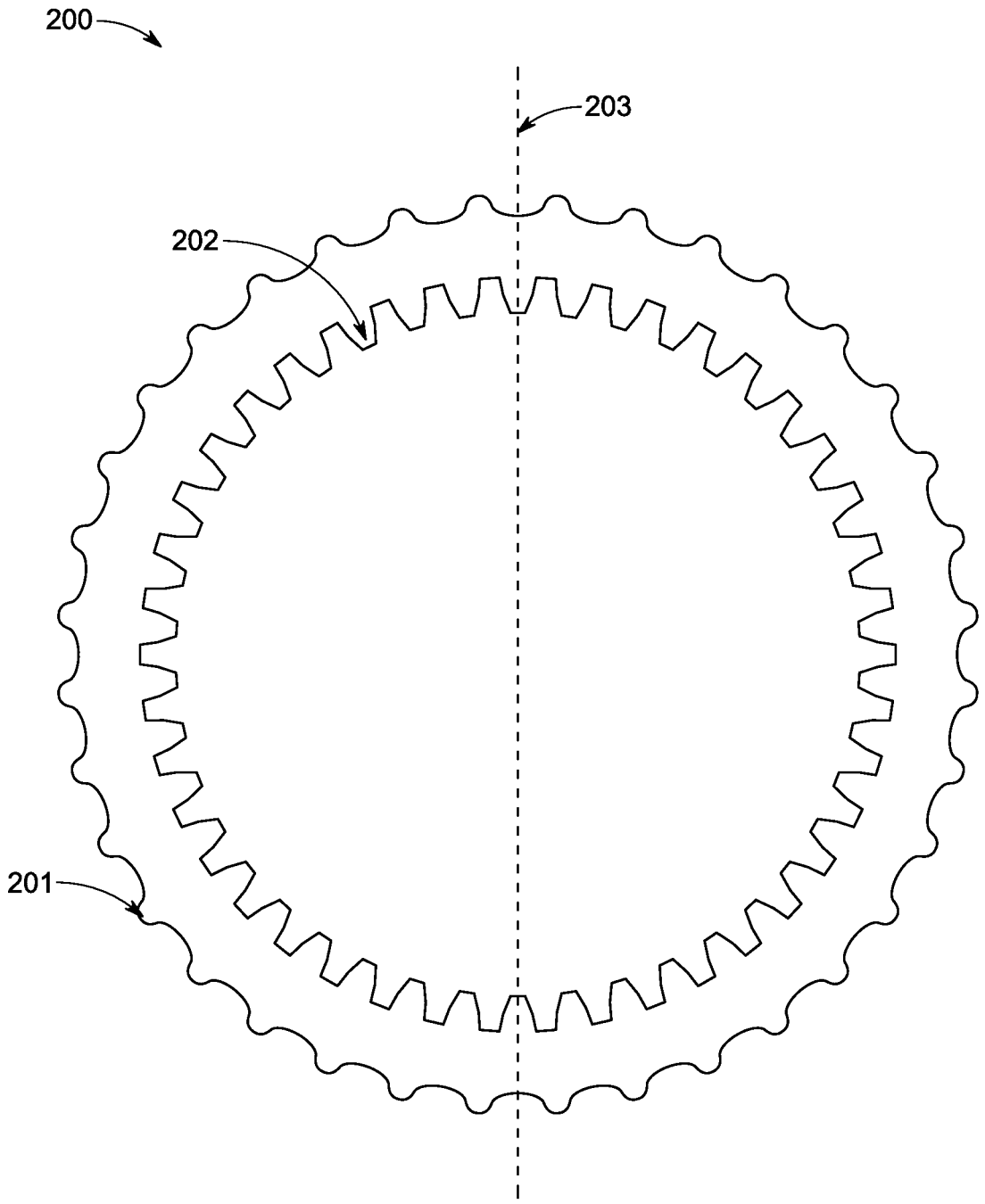
FIG. 2 is a plan view of an outer gear of a fidget coaster according to the disclosure.

FIG. 2 is a planar view of the outer annular gear 200. In an aspect of the disclosure, the outer annular gear 200 includes a plurality of sprockets 201 positioned and around an outer circumference of the outer annular gear 200. This plurality of sprockets 201 may allow a user to spin the outer annular gear 200 for entertainment or fidget and stress relief. The outer annular gear 200 also includes a plurality of inner teeth 202 aligned along and around an inner circumference of the outer annular gear 200. The plurality of inner teeth 202 are configured to engage with and accept planetary gears (not shown, but illustrated as elements 103 in FIG. 1).

The outer annular gear 200 is free to rotate about a central axis 203, which extends out of the two-dimensional plane illustrated in FIG. 2.

Figure 3:
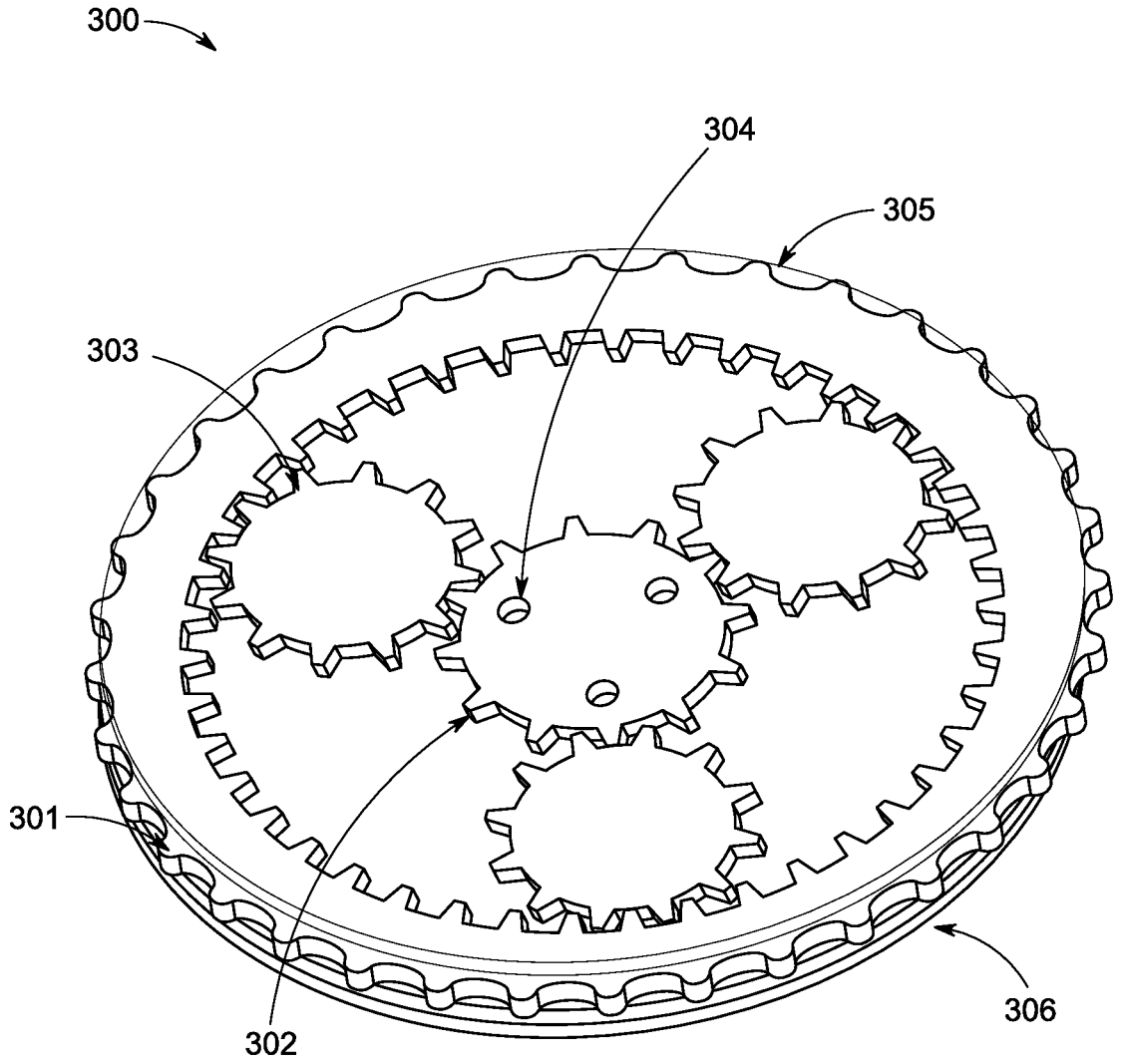
FIG. 3 is a view of a fidget coaster according to the disclosure.

FIG. 3 is a view of a fidget coaster 300 according to the disclosure, showing a fully-assembled fidget coaster 300. The fidget coaster 300 includes a freely-rotating outer gear 301. The fidget coaster 300 includes a central stationary solar gear 302 in mechanical communication with a plurality of planetary gears 303. A plurality of fastener inserts 304 are positioned on the central stationary solar gear 302, configured to accept a plurality of fasteners such as screws. A clear acrylic cover 305 is positioned and attached to the fidget coaster 300 through the plurality of fasteners. A rigid base 306 is positioned below and attached to the stationary central solar gear 302.

The disclosed gears and bottom plate may be made of finished, ⅛" hardwood plywood, such as, e.g., walnut, chestnut or oak. The disclosed gears and bottom plate may be made of plastic materials, such as acrylic. In another aspect of the disclosure, the disclosed gears and bottom plate may be made of carbon fiber, anodized aluminum or other suitable material known to one of skill in the art. The surfaces of the parts for elements illustrated in FIGS. 1-3 may be laser-etched. The parts may be composed of different materials, chosen for those suitable for weight, durability and cost to produce. The disclosed fidget coasters could also serve as coasters for beverage cups in a home bar, with an owner's vanity logo/name imprinted. A generic, non-printed fidget coaster could be available as well. The disclosed fidget coaster may also be customized for commercial enterprises, such as night clubs, taverns, bar & grills, or as souvenirs for sports organizations, music events and venues, other venues or types of enterprises and uses of the fidget coaster.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A fidget coaster device comprising:

a rigid base;

a central solar gear disposed upon the rigid base;

a plurality of planetary gears in mechanical communication with the central solar gear and configured to rotate about the central solar gear;

an outer annular gear disposed to enclose the plurality of planetary gears and the central solar gear, where the plurality of planetary gears are in mechanical communication with and rotate along an inner ring of the outer annular gear;

an acrylic cover positioned upon and in mechanical communication with the central solar gear; and a plurality of fasteners configured to attach the acrylic cover to the central solar gear.

2. The fidget coaster device of claim 1, where the outer annular gear is configured to rotate freely about a center axis defined by the center of the central solar gear.

3. The fidget coaster device of claim 1, where the outer annular gear comprises a plurality of sprockets configured to allow a user to grip and rotate the outer annular gear.

4. The fidget coaster device of claim 1, where the acrylic cover is clear.

5. The fidget coaster device of claim 1, further comprising a non-skid base positioned below and in mechanical communication with the rigid base.

6. The fidget coaster device of claim 5, where the non-skid base comprises a rubber material.

7. The fidget coaster device of claim 6, where the rubber material comprises neoprene.

8. The fidget coaster device of claim 1, where at least one of the rigid base, the central solar gear, the plurality of planetary gears and the outer annular gear comprise a hardwood material or an acrylic material.

9. The fidget coaster device of claim 5, where the non-skid base comprises an annular ring.

10. The fidget coaster device of claim 9, The where the rigid base is imprinted with a graphic image, logo or QR code.

11. The fidget coaster device of claim 1, where the fidget coaster device is configured to accept a beverage cup upon a top surface of the acrylic cover.

12. A spinner coaster for stress relief and focus improvement, the spinner coaster comprising:

a rigid wooden base;

a central toothed gear disposed upon the rigid wooden base;

a plurality of planetary gears positioned around the central toothed gear and configured to rotate around the central toothed gear;

an outer gear comprising an outside circumference and an inside circumference, the outer gear accepting the plurality of planetary gears along the inside circumference, where the plurality of planetary gears rotate along the inside circumference of the outer gear;

a clear acrylic cover disposed upon and attached to the central gear; and a plurality of fasteners configured to attach the acrylic cover to the central solar gear; and a non-skid base positioned under and attached to the rigid wooden base.

13. The spinner coaster of claim 12, where the outer gear comprises a plurality of sprockets configured to allow a user to grip and rotate the outer gear.

14. The spinner coaster of claim 12, where the non-skid base comprises a rubber material.

15. The spinner coaster of claim 14, where the rubber material comprises neoprene.

16. The spinner coaster of claim 12, where at least one of the rigid wooden base, the central toothed gear, the plurality of planetary gears and the outer gear comprise a hardwood material or an acrylic material.

17. The spinner coaster of claim 12, where the non-skid base comprises an annular ring.

18. The spinner coaster of claim 17, where the rigid wooden base is imprinted with a graphic image, logo or QR code.

19. The spinner coaster of claim 12, where the outer gear is configured to rotate freely around the plurality of planetary gears and the central toothed gear.

20. The spinner coaster of claim 12, where the plurality of fasteners comprises screws.

* * * * *